United States Patent [19]

Sippel et al.

[11] Patent Number: 5,009,167

[45] Date of Patent: Apr. 23, 1991

[54] HIGH-EXPLOSIVE PROJECTILE

[75] Inventors: Achim Sippel; Heinz-Josef Kruse, both of Ratingen; Wilfried Becker, Düsseldorf, all of Fed. Rep. of Germany

[73] Assignee: Rheinmetall GmbH, Düsseldorf, Fed. Rep. of Germany

[21] Appl. No.: 296,150

[22] Filed: Jan. 12, 1989

[30] Foreign Application Priority Data

Feb. 12, 1988 [DE] Fed. Rep. of Germany ..... 3804351

[51] Int. Cl.[5] ..... F42B 12/20; F42B 14/02

[52] U.S. Cl. ..... 102/524; 102/473; 102/475; 102/499

[58] Field of Search ..... 102/524, 525, 526, 527, 102/499, 473, 500

[56] References Cited

U.S. PATENT DOCUMENTS

| | | | |
|---|---|---|---|
| 55,761 | 6/1866 | Broadwell | 102/527 |
| 847,149 | 3/1907 | Barlow | 102/526 |
| 1,435,773 | 11/1922 | Wilhelmi | 102/473 |
| 1,596,180 | 8/1926 | Henderson | 102/499 |
| 2,197,841 | 4/1940 | Slaughter | 102/473 |

FOREIGN PATENT DOCUMENTS

| | | | |
|---|---|---|---|
| 2001755 | 4/1971 | Fed. Rep. of Germany . | |
| 1148398 | 12/1957 | France | 102/473 |

OTHER PUBLICATIONS

Rheinmetall *Handbook on Weaponry,* First English Ed., 1982, pp. 508–509.

*Primary Examiner*—David H. Brown
*Attorney, Agent, or Firm*—Spencer & Frank

[57] ABSTRACT

A high-explosive projectile including a projectile body having a forward region and a tail region which transitions to a base, with an explosive charge disposed within the body and detonated by a suitable fuse, and a driving band disposed on the outer circumferential surface of the projectile body in the tail region, wherein the wall thickness of the tail region of the projectile body is substantially the same as the wall thickness of the forward region of the projectile body; the tail region of the projectile body has a cylindrical shape up to its transition to the base and forms a circumferential edge at the transition; and the rearward, gas pressure receiving side of the driving band is disposed adjacent the circumferential edge.

18 Claims, 2 Drawing Sheets

HIGH-EXPLOSIVE PROJECTILE

REFERENCE TO RELATED APPLICATION

The present disclosure relates to the subject matter disclosed in Federal Republic of Germany Patent Application No. P 38 04 351.3, filed Feb. 12th, 1988, the entire specification of which is incorporated herein by reference.

BACKGROUND OF THE INVENTION

The present invention relates to a high-explosive projectile for the generation of fragments including a projectile body containing an explosive charge which is detonated by a suitable fuse, and having a circumferential rotating and/or sealing band disposed on the tail region of the projectile body.

Such a high-explosive projectile in the form of a spinstabilized artillery projectile of 105 mm caliber is disclosed, for example, in Waffentechnisches Handbuch [Handbook on Weaponry], 6th Edition, 1983, page 467, FIG. 1102 and in Rheinmetall Handbook on Weaponry, First English Edition, 1982, page 509, FIG. 1102.

In fin-stabilized form, such a high-explosive projectile is employed, for example, as a multi-purpose highexplosive ammunition for the Leopard II combat tank. This multi-purpose high-explosive projectile which includes either an impact or a proximity fuse, and which further includes a forwardly oriented shaped charge liner for the penetration of armor plate and a thin-walled projectile body for a lateral explosive effect against soft or semi-hard targets.

To ensure the required stability when such highexplosive projectiles are fired from large-caliber gun barrels, these spin and/or fin-stabilized high-explosive projectiles are given relatively thick walls particularly in their tail regions and behind the rotating and/or sealing band (hereinafter sometimes referred to collectively as a driving band). The driving band acts to seal the projectile against the inner surface of the weapon barrel and, in the case of spin stabilized projectiles, to rotate or spin the projectile as it travels through the rifled barrel. Such thick wall regions cause the fragments produced from these regions to become somewhat coarse. Therefore, the fragmentation characteristics of the projectile base and the lower thick-walled tail region of the body are very different than those of the thinner-walled frontal region. Thus, the thick-walled tail region, for example, is broken up into only a few, rather large and thus comparatively slow fragments, while the thinner-walled frontal region breaks into smaller lighter faster fragments.

If, however, for tactical reasons, it is desired to have many smaller equal-sized fragments, additional structural measures, such as, for example, worked-in predetermined break locations, become necessary to produce structured fragments. However, these structural measures can interfere with the projectile's strength a firing.

SUMMARY OF THE INVENTION

It is an object of the present invention to provide for the creation of many small, almost equal-sized fragments without the use of special structural measures in order to create structured fragments, with the fragmentation characteristic in the projectile base and in the rear region of the projectile body being similar to the fragmentation characteristics of the forward part of the projectile body.

This is accomplished in the present invention by a high-explosive projectile including a projectile body having a forward region and a tail region which transitions to a base, an explosive charge disposed within the body and detonated by a suitable fuse, and a driving band disposed on the outer circumferential surface of the projectile body in the tail region, wherein; the wall thickness of the tail region of the projectile body is substantially the same as the wall thickness of the forward region of the projectile body; the tail region of the projectile body has a cylindrical shape up to its transition to the base and forms a circumferential edge at the transition; and the rearward, gas pressure receiving side of the driving band is disposed adjacent the circumferential edge.

The present invention, by providing a far rearward arrangement of the rotating and/or sealing band which is shifted to almost directly at the projectile base, accomplishes a significant reduction of radial pressure stresses on the rearward projectile region from the propelling gases when the projectile is fired from the gun barrel. While still ensuring firing strength, it is thus possible to considerably reduce the wall thickness in the tail region and the body base (i.e. the fragmentation active portion of the base) of the high-explosive projectile. This is made possible by the reduction in sensitivity of the projectile tail region to radial pressure stresses achieved by the measures according to the present invention. In this way, the material of the projectile body as a whole becomes lighter in weight, the number of fragments is more uniform and larger, and more explosive material can be filled into the projectile.

BRIEF DESCRIPTION OF THE DRAWINGS

The invention will now be explained and described in greater detail with reference to the following Figures illustrating two embodiments.

DETAILED DESCRIPTION OF EXEMPLARY EMBODIMENTS

Figure 1:
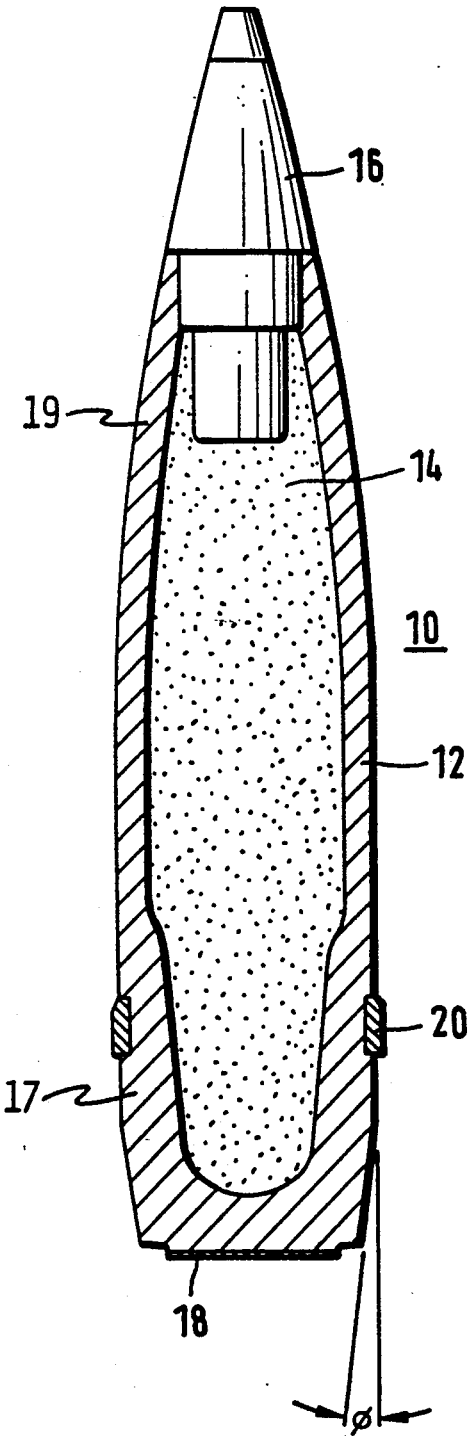
FIG.1 PRIOR ART
FIG. 1 illustrates a known spin-stabilized highexplosive projectile according to the above mentioned prior art.

In FIG. 1, the reference numeral 10 identifies a spin-stabilized high-explosive projectile including a projectile body 12, an explosive substance 14 cast therein and a fuze 16, which can be for example an impact fuze or a adjustable proximity fuze, at the tip. Projectile body 12 is given thicker walls in the tail region 17 and at the base 18 of the high-explosive projectile 10 to ensure strength at firing. The wall thickness in the tail 17 region and the base region 18 of the projectile is about twice as large as in the forward region of the projectile body.

In the prior art projectiles the tail region 17 is provided with a circumferential rotating band 20 at a distance from the projectile base 18 approximately equal to the order of magnitude of the caliber diameter of the projectile body 12. The width of rotating band 20 is about the same as the wall thickness of the thick-walled portion of the projectile body in its tail region 17.

Beginning approximately at one-half the distance of projectile base 18 from rotating band 20, the outer diameter of the tail region 17 of the projectile begins to reduce in the form of a conical taper. This produces a tail slope angle $\phi$ in the range of the customary 5° to 9° between the gun barrel wall (not shown) or, more precisely, between the cylindrical projectile shape and the rearward outer conical surface of the projectile 10.

When this high-explosive projectile 10, which, for example, is made of steel, is broken up by an explosion due to detonation of explosive charge 14, the fragments from the forward projectile region 19 having the thin-walled outer shell and the fragments from the rearward projectile region 17 having the greater wall thickness differ considerably in size and velocity. However, in special cases it may be intended to produce not a few large fragments but many small fragments.

Prior art projectiles are constructed with thick walled tail sections because the problems of firing strength and durability of the projectile are caused by the fact that with decreasing thickness of the walls of the body, its sensitivity to radial stresses increases. A significant radial stress on the projectile body is created by the gas pressure generated behind the rotating band by the propelling charge gases when the high-explosive projectile is fired from a large-caliber gun.

Figure 2:
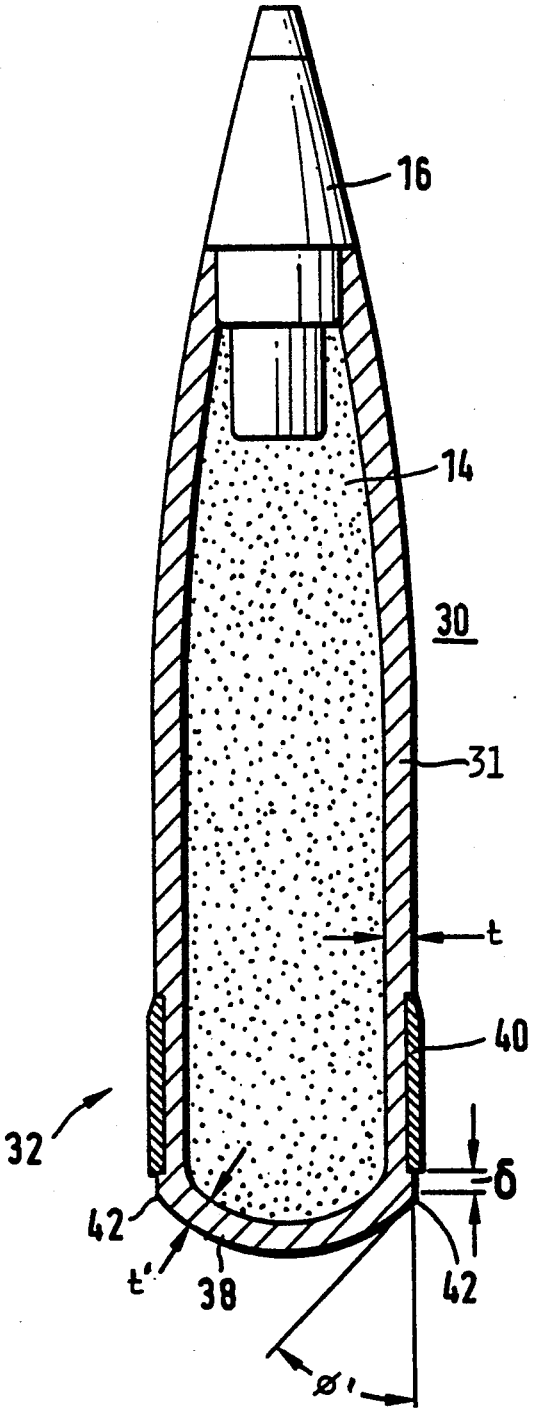
FIG. 2 illustrates a spin-stabilized high-explosive projectile according to a first embodiment of the present invention.

FIG. 2 illustrates an embodiment according to the present invention which depicts a spin-stabilized, full caliber high-explosive projectile 30 in which the wall thickness t' of the projectile in the rear region 32 and in the base region 38 of the projectile is approximately the same as the wall thickness t of the center and forward parts of projectile body 31. A further significant difference with respect to the prior art high-explosive projectile 10 of FIG. 1 is that the rear region 32 of projectile body 31, up to the point where it changes to the projectile base 38, is cylindrical and does not taper conically, thus forming a circumferential edge. Moreover, the rearward, gas pressure receiving side of rotating band 40 is disposed in the direct vicinity of the transition region from the rear projectile region 32 to the projectile base 38, i.e. the band 40 is placed very close to the formed circumferential edge 42, particularly, the distance $\delta$ of rotating band 40 from the circumferential edge 42 according to the present invention, is to be between 0 and 2t inclusive or: $0 \leqq \delta \leqq 2t$. Rotating band 40 may thus be disposed as far back as possible and begin directly at edge 42, i.e., $\delta = 0$. Moreover the width of the rotating band according to the invention should be at least four times and preferably five times the wall thickness t.

As further illustrated in FIG. 2, rather than the flat base 18 of FIG. 1, the projectile base 38 is given an outward or convex curvature in the shape of a spherical or elliptical cup. Due to this shape of the base 38 and since the cylindrical shape of the projectile body 31 extends the length of the body to the base 3, the pressure resistance of the projectile body is increased. Therefore, a value $>10°$ can be achieved for the tail slope angle $\phi'$ at the location of the circumferential edge 42 between the cylindrical outer surface of projectile body 31 (matching the inner surface of the gun barrel not illustrated) and a tangent to the outer surface of the projectile base 38. The preferred range of this tail slope angle $\phi'$ lies between about 20° to 70°, and preferably is about 30°.

Figure 3:
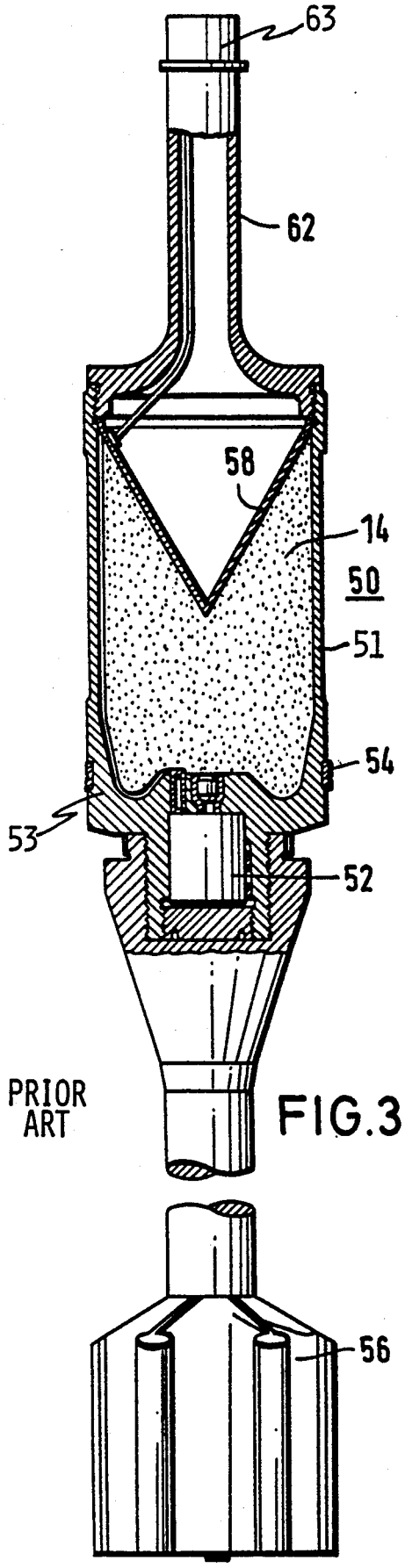
PRIOR ART FIG.3
FIG. 3 illustrates a prior art fin-stabilized multipurpose high-explosive projectile which is part of the available ammunition for the Leopard II combat tank.

FIG. 3 illustrates a prior art full-caliber finstabilized multi-purpose high-explosive projectile, for example, a 120 mm MZ DM 12 A1 projectile, whose warhead 50 includes a thin-walled projectile body 51, an explosive substance 14 filled therein and a base fuse or detonator 52 connected therewith. Warhead 50 fragments upon detonation in a manner similar to that described in reference to high-explosive projectile 10 above and has many of the same design limitations.

The tail region of projectile body 51 and the projectile base 53 of the high explosive warhead 50 are here again about twice as thick as the forward portion of warhead body 51. In its rear cylindrical body region, the warhead body 51 is provided with a circumferential sealing band 54. An almost caliber-sized fin guide mechanism 56 is fastened to the housing of base fuse 52. As part of its multi-purpose function, the warhead 50 is provided with a shaped charge liner 58 for the penetration of armor plate and a forwardly oriented stand-off tube 62 equipped, for example, with means 63 for initiating detonation upon impact.

The different wall thickness in the cylindrical wall region 51 and in the rearward base region 53 leads to the above-described non-uniform fragment formation and resultant effect on the target.

Figure 4:
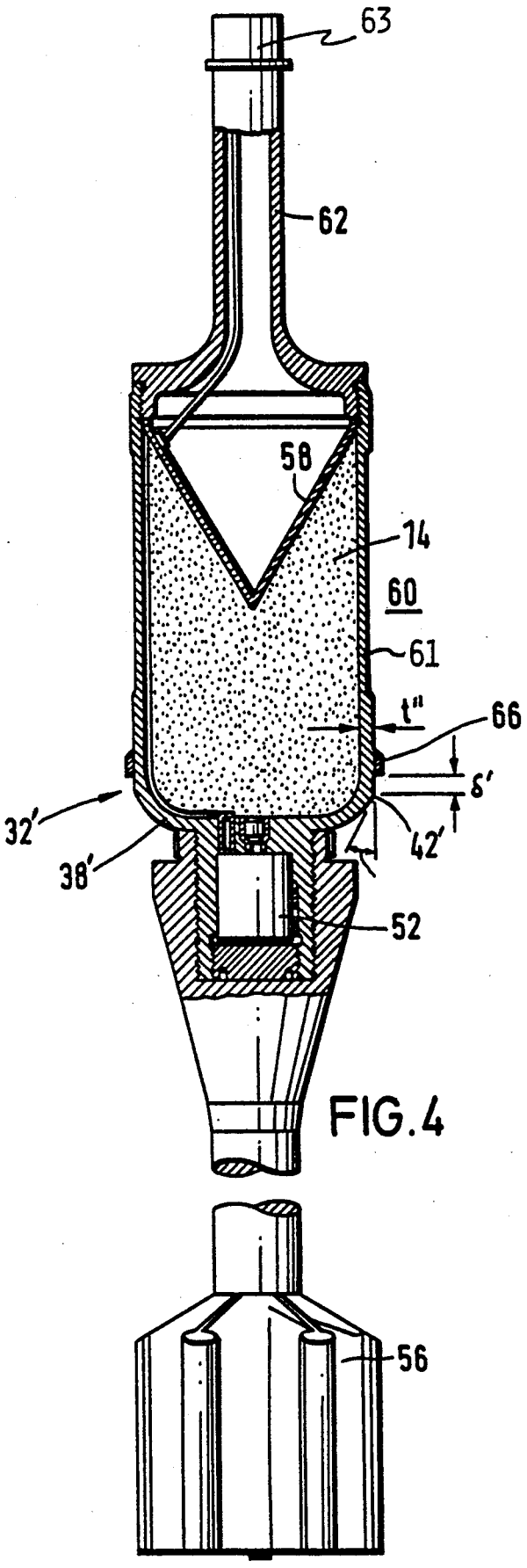
FIG. 4 illustrates a fin-stabilized multi-purpose high-explosive projectile according to a second embodiment of the present invention.

The high-explosive warhead 60 of the projectile according to the invention illustrated in FIG. 4, and including a circumferential sealing band 66, has a wall thickness in the rear or tail region 32' of the projectile body 61 which is of approximately the same order of magnitude as the wall thickness t'' of body 61 in the center region of the warhead. In the rear of tail region 32' of the warhead 60, projectile body 61 has a cylindrical configuration which extends, at a circumferential edge 42', to the projectile base 38' and the rearward, gas-pressure receiving side edge of sealing band 66 is disposed in the direct vicinity of the transition region or circumferential edge 42' between the cylindrical portion of the projectile body 61 and the projectile base 38'. In this transition region from the cylindrical portion of projectile body 61 to the projectile base 38', the distance $\delta'$ of the rearward, gas-pressure receiving side edge of sealing band 66 from the circumferential edge 42' is approximately equal to or less than twice the wall thickness t'' of the cylindrical portion of the projectile body 61. Sealing band 66 may have a width of at least twice the wall thickness t'' of projectile body 61. The projectile base 38' of warhead 60 is distinguished, at least in its outer edge region, by the same wall thickness as projectile body 61 and has a cup-shaped outward or convex curvature. The preferred value for tail slope angle $\phi'$ at circumferential edge 42' is about 25° to 35°.

The shaping and sealing measures according to the present invention considerably reduce the sensitivity of the tail region of the projectile or warhead body and of the projectile base to gas pressure stresses upon firing. This permits a considerable reduction in the wall thickness of the tail region to about the wall thickness of the projectile body in the front region of the projectile or warhead. When the projectile is broken up, this construction produces many small, high-speed fragments in its tail region which thus produces an equalization of the fragmentation characteristic between the projectile body and the projectile tail region.

Since upon detonation at least a considerable portion of the projectile base (i.e. fragmentation active base) is broken up into the same small size fragments, these fragments are able to cover the rearward combat region at the target, the direction opposite to the direction of flight of the projectile, with fragments.

It will be understood that the above description of the present invention is susceptible to various modifications, changes and adaptations, and the same are intended to be comprehended within the meaning and range of equivalents of the appended claims.

What is claimed is:

1. In a high-explosive projectile including a projectile body having a forward region and a tail region which transitions to a base, an explosive charge disposed within said body and detonated by a suitable fuse, and a driving band disposed on the outer circumferential surface of said projectile body in said tail region, the improvement wherein:

the wall thickness of said tail region of said projectile body is substantially the same as the wall thickness of said forward region of said projectile body;

said tail region of said projectile body has a cylindrical shape up to its transition to said base and forms a circumferential edge at said transition;

said projectile body has a tail slope angle of $>10°$ between said outer circumferential surface of the cylindrical said tail region and a tangent to the outer surface of said projectile base at said circumferential edge; and the rearward, gas pressure receiving side of said driving band is disposed adjacent said circumferential edge.

2. A high-explosive projectile as defined in claim 1, wherein said driving band has a width of at least twice said wall thickness.

3. A high-explosive projectile as defined in claim 1, wherein: said driving band has a width of at least four times said wall thickness.

4. A high-explosive projectile as defined in claim 1, wherein said tail slope angle lies between approximately 20° and 70°.

5. A high-explosive projectile as defined in claim 1, wherein said projectile is a fin-stabilized projectile.

6. A high-explosive projectile as defined in claim 1, wherein said rearward gas pressure receiving side of said driving band is located a distance from said circumferential edge which is no greater than twice said wall thickness.

7. A high-explosive projectile as defined in claim 6, wherein said driving band has a width of at least twice said wall thickness.

8. A high-explosive projectile as defined in claim 7, wherein: said projectile is a spin-stabilized projectile; said driving band is a rotating band; and said rotating band has a width of at least four times said wall thickness.

9. A high-explosive projectile as defined in claim 8, wherein said rotating band has a width of five times said wall thickness.

10. A high-explosive projectile as defined in claim 8, wherein, said projectile base has an outward cup-shaped curvature.

11. In a high-explosive projectile including a projectile body having a forward region and a tail region which transitions to a base, an explosive charge disposed within said body and detonated by a suitable fuse, and a driving band disposed on the outer circumferential surface of said projectile body in said tail region, the improvement wherein:

the wall thickness of said tail region of said projectile body is substantially the same as the wall thickness of said forward region of said projectile body;

said tail region of said projectile body has a cylindrical shape up to its transition to said base and forms a circumferential edge at said transition;

said projectile base has approximately the same wall thickness as said projectile body;

said driving band has a width of at least twice said wall thickness; and the rearward, gas pressure receiving side of said driving band is located a distance from said circumferential edge which is no greater than twice said wall thickness.

12. A high-explosive projectile as defined in claim 11, wherein said projectile base has an outward cup-shaped curvature.

13. A high-explosive projectile as defined in claim 12, wherein, said projectile body has a tail slope angle of $>10°$ between said outer circumferential surface of the cylindrical said tail region and a tangent to the outer surface of said projectile base at said circumferential edge.

14. A high-explosive projectile as defined in claim 13, wherein said tail slope angle lies between approximately 20° and 70°.

15. A high-explosive projectile as defined in claim 14, wherein said tail slope angle is approximately 30°.

16. In a high-explosive projectile including a projectile body having a forward region and a tail region which transitions to a base, an explosive charge disposed within said body and detonated by a suitable fuse, and a driving band disposed on the outer circumferential surface of said projectile body in said tail region, the improvement wherein:

the wall thickness of said tail region of said projectile body is substantially the same as the wall thickness of said forward region of said projectile body;

said tail region of said projectile body has a cylindrical shape up to its transition to said base and forms a circumferential edge at said transition;

at least in its outer region, said projectile base has approximately the same wall thickness as said projectile body; and the rearward, gas pressure receiving side of said driving band is disposed adjacent said circumferential edge.

17. A high-explosive projectile as defined in claim 16, wherein, said projectile base has an outward cup-shaped curvature.

18. A high-explosive projectile as defined in claim 17, wherein, said projectile body as a tail slope angle of $>10°$ between said outer circumferential surface of the cylindrical said tail region and a tangent to the outer surface of said projectile base at said circumferential edge.

* * * * *